US006953921B2

(12) United States Patent
Kim

(10) Patent No.: US 6,953,921 B2
(45) Date of Patent: Oct. 11, 2005

(54) BOLOMETRIC HUMIDITY SENSOR AND COOKER USING THE SAME AND METHOD FOR CONTROLLING THE COOKER

(75) Inventor: Sang Doo Kim, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/432,282

(22) PCT Filed: Mar. 31, 2001

(86) PCT No.: PCT/KR01/00545

§ 371 (c)(1),
(2), (4) Date: May 20, 2003

(87) PCT Pub. No.: WO02/42689

PCT Pub. Date: May 30, 2002

(65) Prior Publication Data

US 2004/0026413 A1 Feb. 12, 2004

(30) Foreign Application Priority Data

Nov. 21, 2000 (KR) ..... P2000-69275
Nov. 21, 2000 (KR) ..... P2000-69276

(51) Int. Cl.[7] ..... H05B 6/50
(52) U.S. Cl. ..... 219/707; 438/54; 250/332
(58) Field of Search ..... 219/707, 705, 219/492; 538/18, 225 D; 438/54; 250/370.01, 336.1, 338.1, 338.3, 338.4, 338.5, 332; 257/430, E31.052

(56) References Cited

U.S. PATENT DOCUMENTS 4,734,554 A * 3/1988 Tateda et al. ..... 219/705
5,260,225 A * 11/1993 Liu et al. ..... 438/54
5,554,849 A * 9/1996 Gates ..... 250/370.08
5,783,807 A 7/1998 Uehashi et al.
2004/0183519 A1 * 9/2004 Lymer ..... 324/95

FOREIGN PATENT DOCUMENTS

| | | |
|---|---|---|
| JP | 63041732 | 2/1988 |
| JP | 10010068 | 1/1998 |
| JP | 11201820 | 7/1999 |
| KR | 20-1987-0001387 | 2/1987 |
| RU | 2143088 | 12/1999 |
| RU | 2145135 | 1/2000 |
| SU | 887945 | 12/1981 |
| WO | WO9705429 | 2/1997 |

* cited by examiner

*Primary Examiner*—Quang T. Van
(74) *Attorney, Agent, or Firm*—Fleshner & Kim LLP

(57) ABSTRACT

A bolometric humidity sensor, cooker having the same applied thereto, and method for controlling the cooker are provided. The bolometric humidity sensor has two static bolometric temperature sensors for detecting humidity more accurately. A cooker may have such a bolometric humidity sensor fitted to one side of a bracket on an air outlet for deflecting air flowing out of the cooker. This arrangement allows for more accurate detection of the humidity in the cooking chamber. A method of controlling a cooker could include the use of such a sensor to permit a cooking time period to differ depending on whether the cooked food is wrapped.

5 Claims, 9 Drawing Sheets

BOLOMETRIC HUMIDITY SENSOR AND COOKER USING THE SAME AND METHOD FOR CONTROLLING THE COOKER

TECHNICAL FIELD

The present invention relates to a humidity sensor of a positive temperature coefficient bolometric temperature element in which a resistance is linearly proportional to a temperature change, a cooker of the bolometric humidity sensor, and a method for controlling the cooker.

BACKGROUND ART

In general, a microwave oven in which food is heated by microwaves shows dewing either on an inside surface of a door and/or on an inside wall of a cooking chamber owing to water vapor in the cooking chamber generated when the food is heated. To prevent this, a fan is used to blow an appropriate amount of dry air into the cooking chamber for discharging the air to outside of the cooking chamber. The microwave oven is provided with a humidity sensor at an air outlet for detecting a humidity of the air for implementing auto cooking by detecting a heated degree of the food according to the humidity. Of the humidity sensors used for the microwave ovens, a humidity sensor of a thermister element is typical one, in which the resistance is varied with temperature.

A humidity sensor of the thermister element and a method for controlling a microwave oven of the humidity sensor will be explained, with reference to the attached drawings. FIG. 1 illustrates a section of a related art thermister type humidity sensor, FIG. 2 illustrates a front and a plan views of the related art thermister type humidity sensor, and FIG. 3 illustrates a circuit of a related art thermister type humidity sensor.

Referring to FIG. 1, the related art thermister type humidity sensor 10 is provided with two spaces formed by a stem 11 and a cap 12, a humidity sensing thermister 13 in one of the spaces, and a temperature compensating thermister 14 in the other space. Each of the thermisters 13 and 14 are connected to lead pins 15 passed through the stem 11 by a platinum wire 16 to form a circuit. There is a detection hole 17 in a top of the cap 12 of the humidity thermister 13 for introduction of water vapor. The thermisters 13 and 14 are of NTC thermisters in which temperature and resistance are inversely proportional.

Referring to FIG. 2, the humidity sensor of an NTC thermister is provided with a front case 1 and a rear case 2 for forming spaces thermisters are to be fitted therein respectively, a heat unit 3 fitted in the front case 1 for accommodating the thermisters 13 and 14 and maintaining a temperature thereof, shielded wires 5 connected to the lead pins for applying a device signal and preventing noise. There are a plurality of fastening holes for fitting the case.

Referring to FIG. 3, the thermister type humidity sensor is provided with the humidity sensing thermister 13, the temperature compensating thermister 14 connected with the humidity sensing thermister 13 in series for compensating a voltage variation caused by a resistance variation of the humidity sensor thermister 13, an amplifier 100 having an inversion terminal (−) for receiving an output voltage of the humidity sensing thermister 13 and a non-inversion terminal (+) for receiving a voltage, for amplifying a difference of the voltages, and a variable resistor VR for providing a voltage variation of the output voltage caused by the resistance variation of the humidity sensing thermister 13 and applying the voltage variation to a non-inversion (+) terminal of the amplifier 100. The foregoing thermister type humidity sensor detects the humidity by using a resistance difference caused by a temperature difference between the humidity sensing thermister 13 and the temperature compensating thermister 14 when water vapor is introduced into the humidity sensing thermister 13 through a detection hole 17 in the stem 11.

A related art method for automatic control of a cooker having the thermister type humidity sensor applied thereto will be explained. FIG. 4 illustrates a flow chart showing the steps of a related art method for controlling a cooker having the thermister type humidity sensor applied thereto.

Referring to FIGS. 3 and 4, when the user selects a cooking setting mode of the cooker for cooking a food to a desired state, the cooker puts the fan (not shown) into operation for a preset blowing time period (S10), and determines whether the blowing is completed (S11). When the blowing is completed as a result of the determination (S11), the magnetron (not shown) is put into operation and the fan blowing is continued (S13), when the humidity sensing thermister senses a variation of the humidity in the cooker generated as the magnetron is put into operation. That is, a resistance of the humidity sensing thermister is varied with the water vapor in the cooker generated as the magnetron is put into operation, and the output voltage is varied with the resistance variation. Then, the output voltage V1 of the humidity sensing thermister is applied to an inversion terminal (−) of the amplifier 100, and perfection of a zero balance is determined (S14). That is, at the time the magnetron is put into operation, the variable resistor VR is varied so that a voltage V2 to the non-inversion terminal (+) of the amplifier 100 is the same with a voltage V1 applied to the inversion terminal (−) of the amplifier 100, for initializing an output voltage of the amplifier 100, i.e., a sensor output value V0. Next, upon perfection of the zero balance (S14), setting of the sensor output value V0 from the amplifier 100 is determined of being an initial value Vref (S15). As a result of the determination (S15), if it is found the sensor output value V0 is set to the initial value Vref, reach to a voltage variation ΔV required for a specific menu with reference to the sensor initial value is determined. That is, after the sensor output V0 is set as the initial value Vref, there is a voltage variation ΔV between the voltage of a menu the user selected and the sensor initial value Vref, and reach of the sensor output V0 to the voltage variation ΔV is determined. As a result of the determination (S16), if the sensor output V0 reaches to the voltage variation ΔV of the menu with reference to the sensor initial value Vref, a time period T1 required to the voltage variation ΔV is calculated, to calculate a main operation time period (S17). Next, the magnetron is operated for the main operation time period T2 period, and fan is blown, to cook the food, and the magnetron and the fan are stopped (S18). If the sensor output V0 is not set as the sensor initial value Vref, pass of a preset operation time period of the magnetron is determined (S19). As a result of the determination (S19), if it is found that the preset operation time period is passed, the sensor initial value Vref is set (S20), after the present voltage variation ΔV reach time period is increased by '1' second (S21), the reach to the voltage variation ΔV of the menu with reference to the sensor initial value Vref is determined (S22). As a result of the determination (S22), if the voltage variation is not reached to the voltage variation ΔV of the menu, the process proceeds to the step (S21) of increasing the voltage variation ΔV reach time period by '1' second. Opposite to this, if the voltage variation is reached to the voltage variation ΔV of the menu, a step (S17) of calculating the main operation time period T2 is carried out by calculating a time period T1 required to reach to the voltage variation ΔV. Meanwhile, as a result of the determination (S16), if it is found that the sensor output V0 is not reached to the voltage variation ΔV of the menu with reference to the sensor initial value Vref, the step (S21) of increasing the present voltage variation ΔV reach time period by "1" second is carried out until the voltage variation reaches to the required voltage variation of the menu. At the end, a humidity change in the cooker is expressed as the sensor output V0 of the thermister type humidity sensor.

FIG. 5 illustrates a graph showing characteristics of a related art thermister type humidity sensor, wherefrom it can be known that a negative temperature coefficient thermister element has a non-linear resistance variation to a temperature change. That is, the negative temperature coefficient thermister element has a non-linear-inversely proportional relation in which a resistance is decreased if a temperature is increased, thereby showing difficulty in predicting a temperature to a humidity change since the sensor output is not linear. Because of this, in a case when the related art thermister type humidity sensor is fitted to the air outlet of the cooker and detects humidity in the cooking chamber, accurate detection of the humidity is not possible. At the end, the microcomputer can not know an exact degree of cooking of the food, and, accordingly, can not control output of the magnetron and operation of the fan, precisely. Particularly, if a function to maintain a temperature of the food constant is selected, such a disadvantage becomes so distinctive that the user can not maintain a temperature of the food constant properly. Moreover, in the case of cooker having the related art thermister type humidity sensor applied thereto, control of a cooking time period is not possible if the food wrapped, since the cooker is not provided with any counter measure for a case of wrapped food.

In the meantime, in order to maintain a thermal equilibrium between the related art thermister type humidity sensors, the cap and the stem are provided for enclosing the elements, the elements are placed in a heater unit, and the heater unit is fixed to a case by welding. When the humidity sensor is fitted to a bracket or the like of the cooker, care should be taken so that a good thermal contact is made between the case and the bracket. At the end, above condition makes a fabrication process complicated, and fitting the humidity sensor to the cooker or the like difficult.

DISCLOSURE OF INVENTION

Accordingly, the present invention is directed to a bolometric humidity sensor, a cooker of the bolometric humidity sensor, and a method for controlling the cooker that substantially obviates one or more of the problems due to limitations and disadvantages of the related art.

An object of the present invention is to provide a bolometric humidity sensor, in which a bolometric element having a linear characteristic is used for accurate detection of the humidity, and which has a simple fabrication process.

Another object of the present invention is to provide a cooker having a bolometric humidity sensor applied thereto, in which the bolometric humidity sensor is fitted to a position a humidity in a cooking chamber can be detected, accurately.

Further object of the present invention is to provide a method for controlling a cooker, which permits a user to cook the best by using the bolometric humidity sensor.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the bolometric humidity sensor includes a case, a stem having a first detecting bole provided in the case for introduction of water vapor, a cap fitted to a top part of the stem to form spaces, a humidity sensing bolometric temperature sensing element having a resistance varied with a temperature provided in the space the first detecting hole is opened thereto, a temperature compensating bolometric temperature sensing element having a resistance varied with a temperature provided in the space the first detecting hole is not opened thereto, and shielded wires connected to the bolometric temperature sensing elements for transmission of signals and prevention of noise.

The bolometric temperature sensing elements are patterned on a wafer, and of a positive temperature coefficient bolometric temperature sensing elements each having a resistance linearly proportional to a temperature variation.

The bolometric temperature sensing elements connected to shielded wires and connected to three lead pins passed through the stem, such that one element is connected to one lead pin respectively, and the remaining one pin is connected to both of the elements.

The case includes a rear case having a supporting member for supporting the cap and the stem such that the stem faces an open surface, and a front case having a size slightly smaller than the rear case for pressing down, and fastening the supporting member.

The front case has a plurality of second detection holes formed in a surface facing the stem in a front direction for introduction of water vapor, and the detection holes are formed in parts distanced from a center of the front case.

The bolometric humidity sensor further include a circuit including an amplifier having an amplifier having an inversion (−) terminal for receiving an output voltage of a humidity detected at the humidity sensing bolometric temperature element and a non-inversion (+) terminal for receiving a preset reference voltage, for amplifying a difference of the output voltage and the reference voltage, a variable resistor for applying the reference voltage to the non-inversion (+) terminal on the amplifier, and a resistor having one end connected to the variable resistor and the other end connected to the temperature compensating bolometric temperature sensing element.

A bridge circuit is formed by matching the humidity sensing bolometric temperature sensing element and the resistor, and the temperature sensing bolometric sensing element and the variable resistor.

In another aspect of the present invention, there is provided a cooker having a bolometric humidity sensor applied thereto including a cooking chamber in a body of the cooker having a space for accommodating food, a magnetron for providing a heat for heating the food, a fan for circulating air inside of the cooking chamber, a "]" formed bracket at an end of an air outlet, the air inside of the cooking chamber is discharged to outside of the cooking chamber by an action of the fan, for deflecting an air flow direction, bolometric humidity sensor inserted in the bracket for sensing a humidity of the outlet air, and a microcomputer for adjusting loads on the magnetron and the fan, and a signal of the bolometric humidity sensor.

The body has a protrusion at a part facing the bolometric humidity sensor protruded toward the bolometric humidity sensor for increasing a flow speed of the outlet air.

In further aspect of the present invention, there is provided a method for controlling a cooker, comprising the steps of (1) a microcomputer putting a magnetron into operation, a bolometric humidity sensor detecting a humidity, and an initial value being set according to a sensor output, (2) calculating a main operation time period by using a time period the set sensor initial value reaches to the sensor output of a menu, (3) after the main operation time period is calculated, detecting an output variation of the sensor at present sampling time intervals through the bolometric humidity sensor for determining presence of wrap, (4) after the output variation is detected, determining reception of a heat key, (5) when it is found that the heat key is received as a result of the determination, carrying out cooking until a voltage variation corresponding to a temperature of a selected key is detected through the bolometric humidity sensor, and stopping operation of the magnetron and the fan, and (6) when it is found that the heat key is not received as a result of the determination, determining the output variation of being greater than a preset constant, to change the main operation time period.

In a case the output variation is greater than the preset constant, the cooking is determined to be a case with wrap, the magnetron and the fan are operated for a time period set longer than the main operation time period.

In a case the output variation is smaller than the preset constant, the cooking is determined to be a case without wrap, the magnetron and the fan are operated for the main operation time period only.

It is to be understood that both the foregoing general description and the following detailed description are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 1:
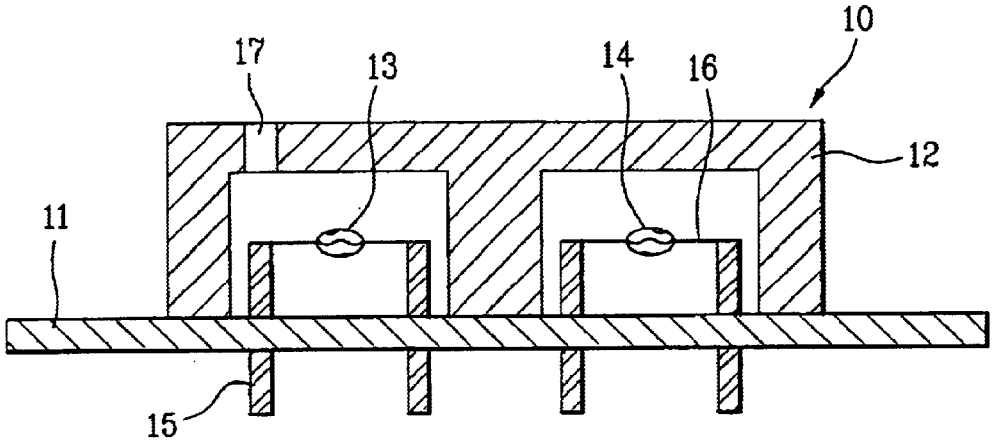
FIG. 1 Related Art
FIG. 1 illustrates a section of a related art thermister type humidity sensor.
Figure 2:
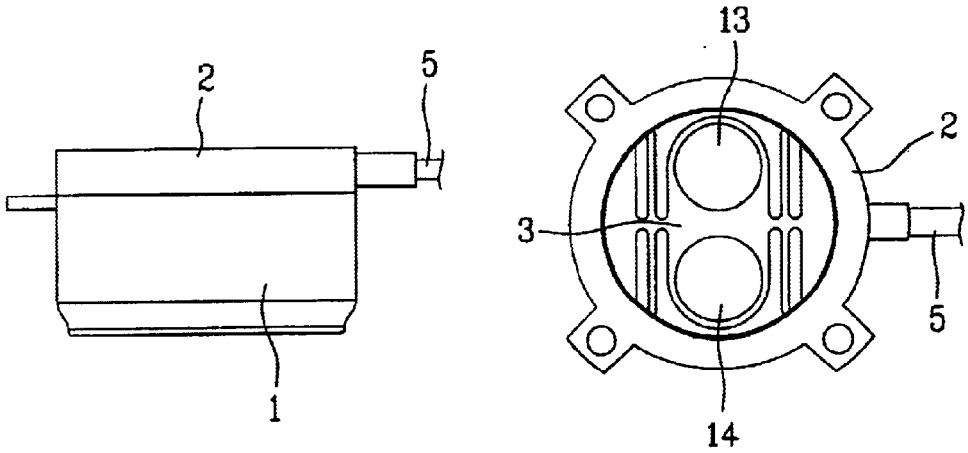
FIG. 2 Related Art
FIG. 2 illustrates front and plan views of a related art thermister type humidity sensor.
Figure 3:
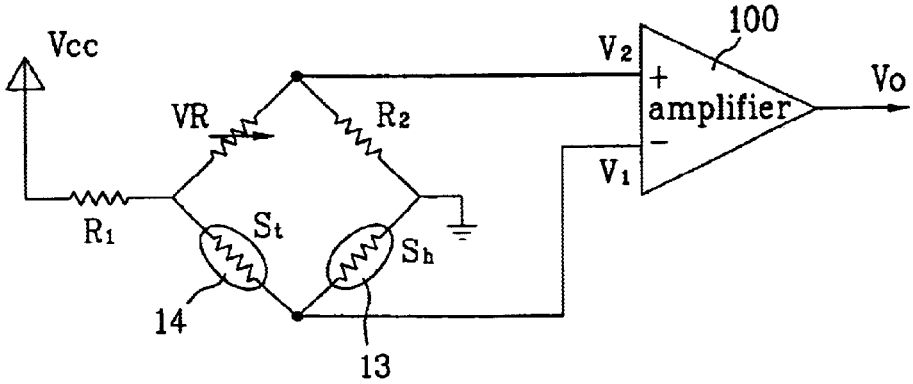
FIG. 3 Related Art
FIG. 3 illustrates a circuit of a related art thermister type humidity sensor.
Figure 4:
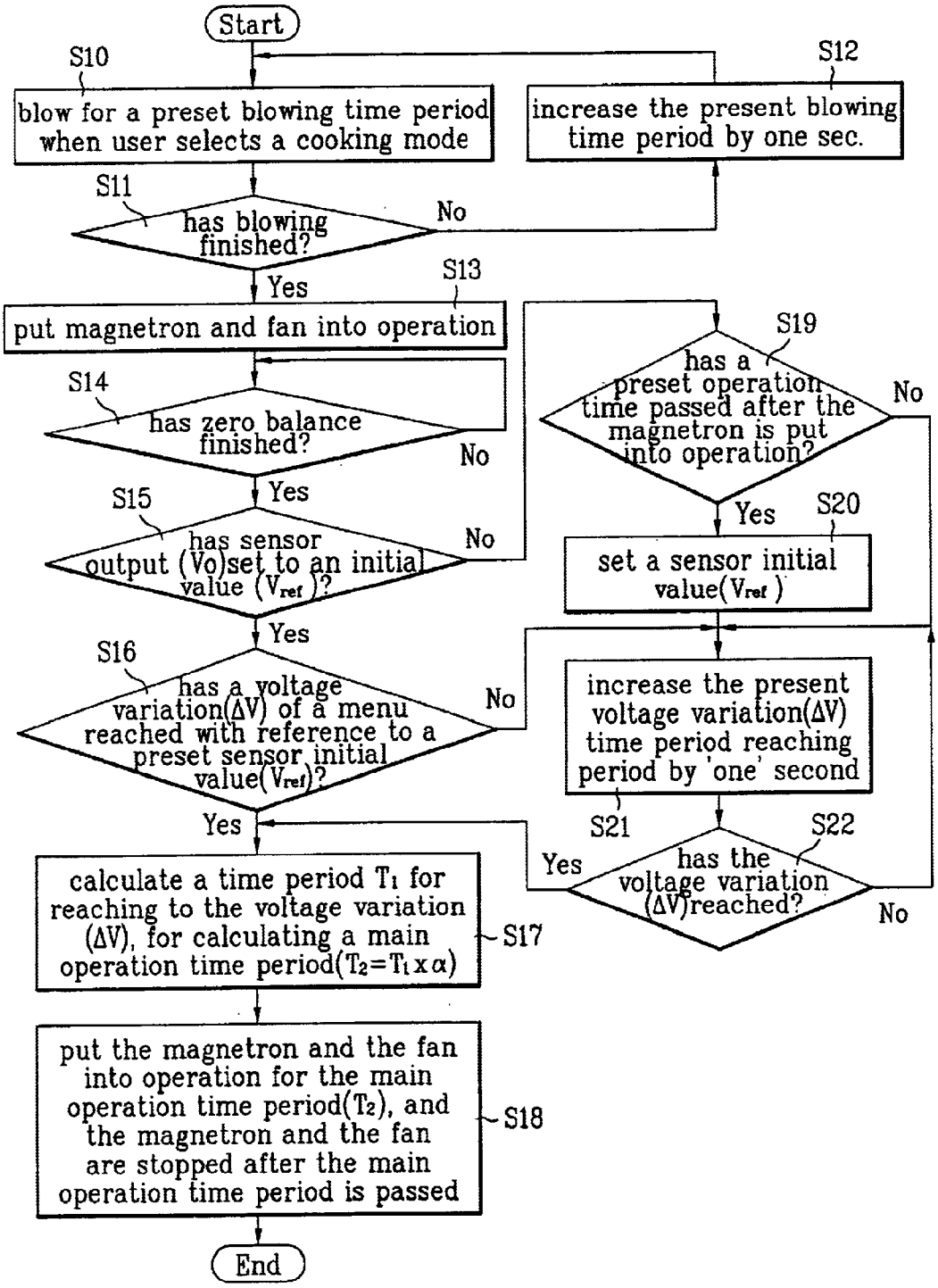
FIG. 4 Related Art
FIG. 4 illustrates a flow chart showing the steps of a related art method for controlling a cooker having the thermister type humidity sensor applied thereto.
Figure 5:
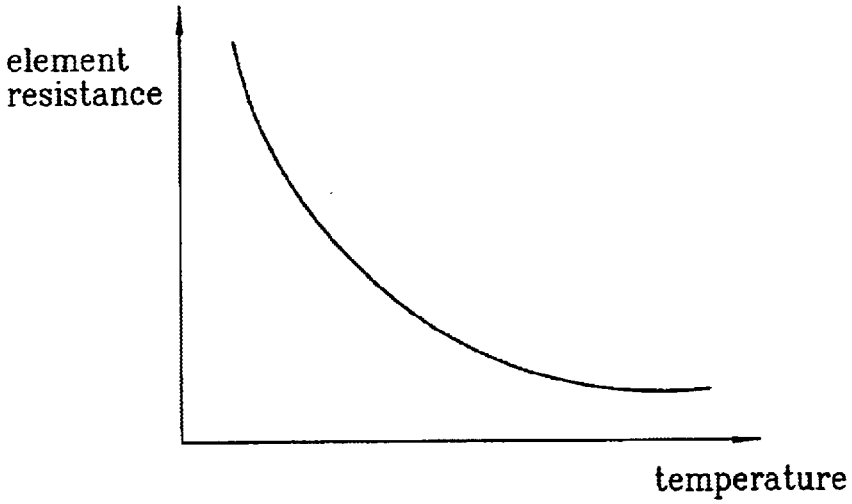
FIG. 5 Related Art
FIG. 5 illustrates a graph showing characteristics of a related art thermister type humidity sensor.
Figure 6:
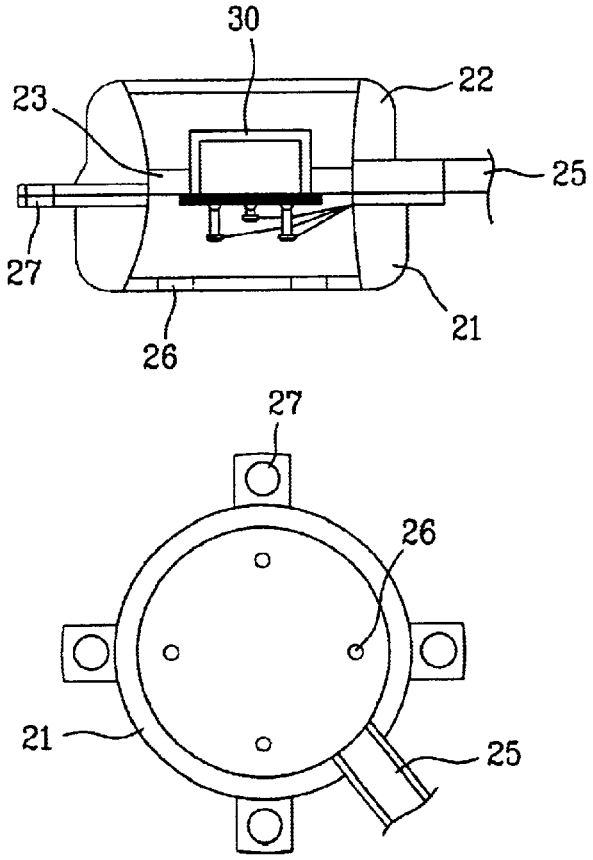
FIG. 6 illustrates a partial section and a plan view of a bolometric humidity sensor in accordance with a preferred embodiment of the present invention.

Reference will now be made in detail to the preferred embodiments of the present invention, examples of which are illustrated in the accompanying drawings. FIG. 6 illustrates a partial section and a plan view of a bolometric humidity sensor in accordance with a preferred embodiment of the present invention.

Referring to FIG. 6, the bolometric humidity sensor in accordance with a preferred embodiment of the present invention includes cases 21 and 22 for protecting components fitted in an inside thereof, an element part 30 of a stem and a cap for accomodating an element, and shielded wires 25 connected to the element part through the cases for preventing noise.

Figure 7:
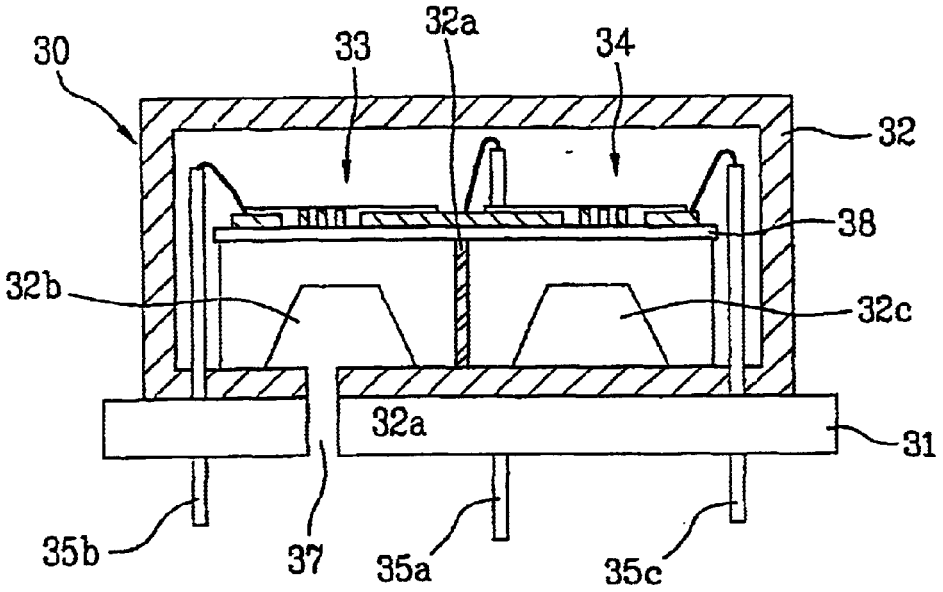
FIG. 7 illustrates a section of a bolometric humidity sensor in accordance with a preferred embodiment of the present invention.

FIG. 7 illustrates a section of a bolometric humidity sensor in accordance with a preferred embodiment of the present invention.

Referring to FIG. 7, the element part 30 includes a stem 31 having a first sensing hole 37 for introduction of a water vapor therethrough, and a cap 32 fitted to a top of the stem to form divided spaces. The spaces includes a space 32*b* in communication with a first detection hole 37 formed a partition 32*a*, and a space 32*c* closed to the first detection hole. There is a bolometric temperature element 33 in the space 32*b* having the first detection hole 37 for sensing a humidity, and there is a bolometric temperature element 34 in the space 32*c* having no first detection hole, for compensating a temperature. The bolometric temperature sensors 33 and 34 are ones patterned on a common wafer 38, are of positive temperature coefficient bolometric elements, in each of which a resistance is linearly proportional to a temperature variation. That is, the temperature element 33 or 34 exhibits a linear resistance rise if a temperature of the temperature element 33 or 34 rises, and vice versa. The temperature sensors 33 and 34 form one circuit by lead pins. There are three lead pins in total connected to a wire branched from the shield wire 25, passed both through the stem 31 and the cap 32, and connected to the temperature sensors. One 35*b* of the lead pins is connected to the humidity sensing bolometric temperature element 33, the other one 35*c* is connected to the temperature compensating bolometric temperature sensor 34, and the third one 35*a* is connected both to the humidity sensing bolometric temperature element 33 and the temperature compensating bolometric temperature sensor 34 as a common terminal.

A shape of the cases accommodating the element part will be explained in detail.

Referring to FIG. 6, the case includes cylindrical front and rear cases 21 and 22, and the element part 30 is fixed in a space formed by the cases with a separate supporting member 23. The supporting member 23 supports the cap and the stem containing the temperature sensors, to be fixed to the cases 21 and 22, and no heat unit is required for thermal equilibrium in the related art. The supporting member 23 is rest on a step formed in the rear case 22 in a position the stem faces the front case 21, i.e., in a position the first detection hole faces the front case, and the front case 21 is coupled to a front face of the rear case 22 as the front case 21 presses the supporting member 23. In this instance, though not shown, the front case 21, with a size slightly smaller than the rear case 22, presses the supporting member 23 rest on the step, to fix the supporting member 23 when the front case is coupled to the rear case. There are a plurality of second detection holes 26 in a surface facing the stem of the front case 21 in a front direction for introduction of water vapor. That is, since the second detection holes 26 face the first detection hole in the stem, the water vapor flowed through the case can be introduced into the element part with ease, and a difference of sensitivity caused by a position of the humidity sensor can be reduced to the maximum. It is preferable that the second detection holes 26 are formed in parts away from a center of the front case 21, for protecting the element from direction dispersion of water vapor containing air. For an example, four of the second detection holes 26 may be formed in a circumferential part of the front case 21 at 90°. There are a plurality of fastening holes 27 in outer circumferences of the front case 21 and the rear case 22 for fitting the cases 2.

In the foregoing bolometric humidity sensor, the water vapor laden air is introduced to the space the humidity sensing bolometric temperature element 33 is provided therein through the second detection holes 26 and the first detection hole 37. The humidity sensing bolometric temperature element 33 is influenced from a temperature of the water vapor laden air, while the temperature compensating bolometric temperature element 34 is influenced from an environmental air. At the end, since the water vapor laden air has a temperature lower than the environmental air, a resistance of the humidity sensing bolometric temperature element 33 is smaller than a resistance of the temperature compensating bolometric temperature element 34, a difference of the resistances may be used for detection of the humidity.

Figure 8:
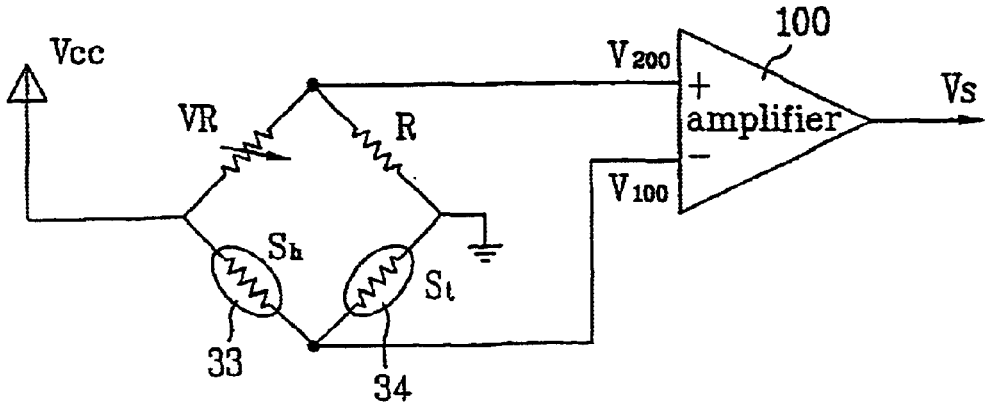
FIG. 8 illustrates a circuit of a bolometric humidity sensor in accordance with a preferred embodiment of the present invention.

A circuit for detection of a humidity of the bolometric humidity sensor will be explained in detail. FIG. 8 illustrates a circuit of a bolometric humidity sensor in accordance with a preferred embodiment of the present invention.

Referring to FIG. 8, the bolometric humidity sensor in accordance with a preferred embodiment of the present invention includes a humidity sensing bolometric temperature element 33 and a temperature compensating bolometric temperature element 34, an amplifier 100 having an inversion (−) terminal for receiving an output voltage of a humidity detected at the humidity sensing bolometric temperature element 33 and a non-inversion (+) terminal for receiving a preset reference voltage, for amplifying a difference of the output voltage and the reference voltage, a variable resistor VR for applying the reference voltage to the non-inversion (+) terminal on the amplifier 100, and a resistor R having one end connected to the variable resistor VR and the other end connected to the temperature compensating bolometric temperature sensing element 34. The bolometric humidity sensor has a bridge circuit in which the humidity sensing bolometric temperature sensing element 33 and the resistor R are positioned oppositely, and the temperature compensating bolometric temperature sensing element 34 and the variable resistor VR are positioned oppositely. The detailed work of the bolometric humidity sensor having the foregoing circuit will be explained, later.

Figure 9:
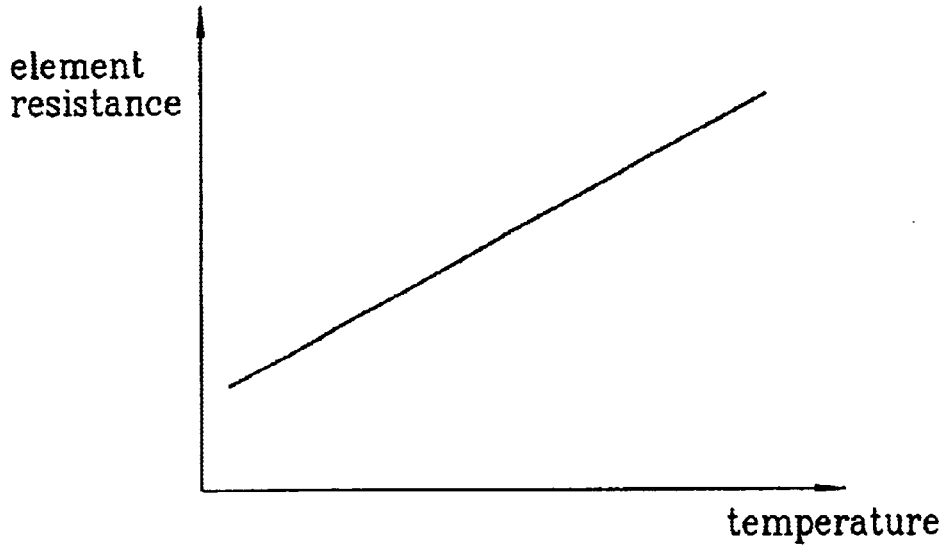
FIG. 9 illustrates a graph showing characteristics of a bolometric humidity sensor in accordance with a preferred embodiment of the present invention.

FIG. 9 illustrates a graph showing characteristics of a bolometric humidity sensor in accordance with a preferred embodiment of the present invention, where an ordinate represents a resistance, and an abscissa represents a temperature.

Referring to FIG. 9, it can be known that the circuit of a bolometric humidity sensor has a resistance variation linearly proportional to a temperature variation. This is because positive temperature coefficient bolometric elements are applied to the bolometric humidity sensor of the present invention, that facilitates an easy prediction of a resistance to a variation of temperature as, different from the related art thermister element, the resistance variation is linearly proportional to the temperature variation.

Figure 10:
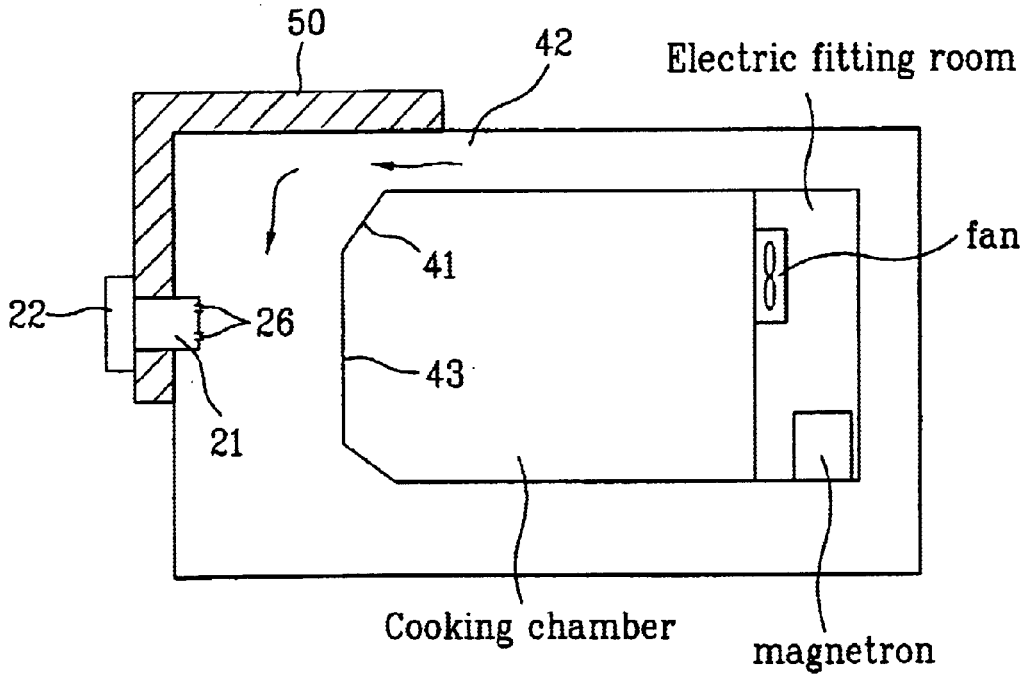
FIG. 10 illustrates a partial section showing a bolometric humidity sensor of the present invention applied to a cooker.

A cooker having the foregoing bolometric humidity sensor applied thereto will be explained. FIG. 10 illustrates a partial section showing a bolometric humidity sensor of the present invention applied to a cooker.

Referring to FIG. 10, the cooker of the present invention includes a body 41 having a cooking chamber (not shown) with a space for accommodating food, and an electric fitting room (not shown) for fitting various devices. In the electric fitting room, there are a magnetron.(not shown) for providing a heat for heating the food, and a fan (not shown) for circulating air inside of the cooking chamber. There is microcomputer (not shown) for controlling loads on the magnetron and the fan, and a signal of the bolometric humidity sensor. There is an air outlet 42 at one side of the body 41 for discharging air from the cooking chamber to outside of the cooking chamber by a work of the fan, and there is a "]" formed bracket 50 at an end of the air outlet for deflecting an air flow direction and fitting the bolometric humidity sensor. The bracket 50 is a plate bent in a "]" form for deflecting a discharge air flow by 90° in cooperation with one side of the body 41, in which the bolometric humidity sensor is inserted, with the front case 22 thereof projected into a flow path. Accordingly, the second detection holes 26 in the front case 22 are positioned in a surface facing the air outlet of the bracket 50. Therefore, flow of the discharge air is made active by the bracket 50 as the discharge air passes through the air outlet 42, facilitating a smooth introduction of the discharge air through the second detection holes 26, which improves a sensor sensitivity. For improving the sensor sensitivity further, it is preferable that a protrusion 43 is formed toward the front case on the body 41 at a part opposite to the front case, for reducing a sectional area of the flow path through which the discharge air passes, that improves a sensor sensitivity as the flow speed becomes faster. The discharge air introduced into the element part through the second detection holes 26 and the first detection hole give an influence to the humidity sensing bolometric temperature sensing element, to cause a difference of resistance of the humidity sensing bolometric temperature sensing element and the temperature compensating bolometric temperature sensing element. According to this, the microcomputer detects a humidity from the resistance difference, to know a cooking degree of the food, and to control the magnetron and the like.

Figure 11A:
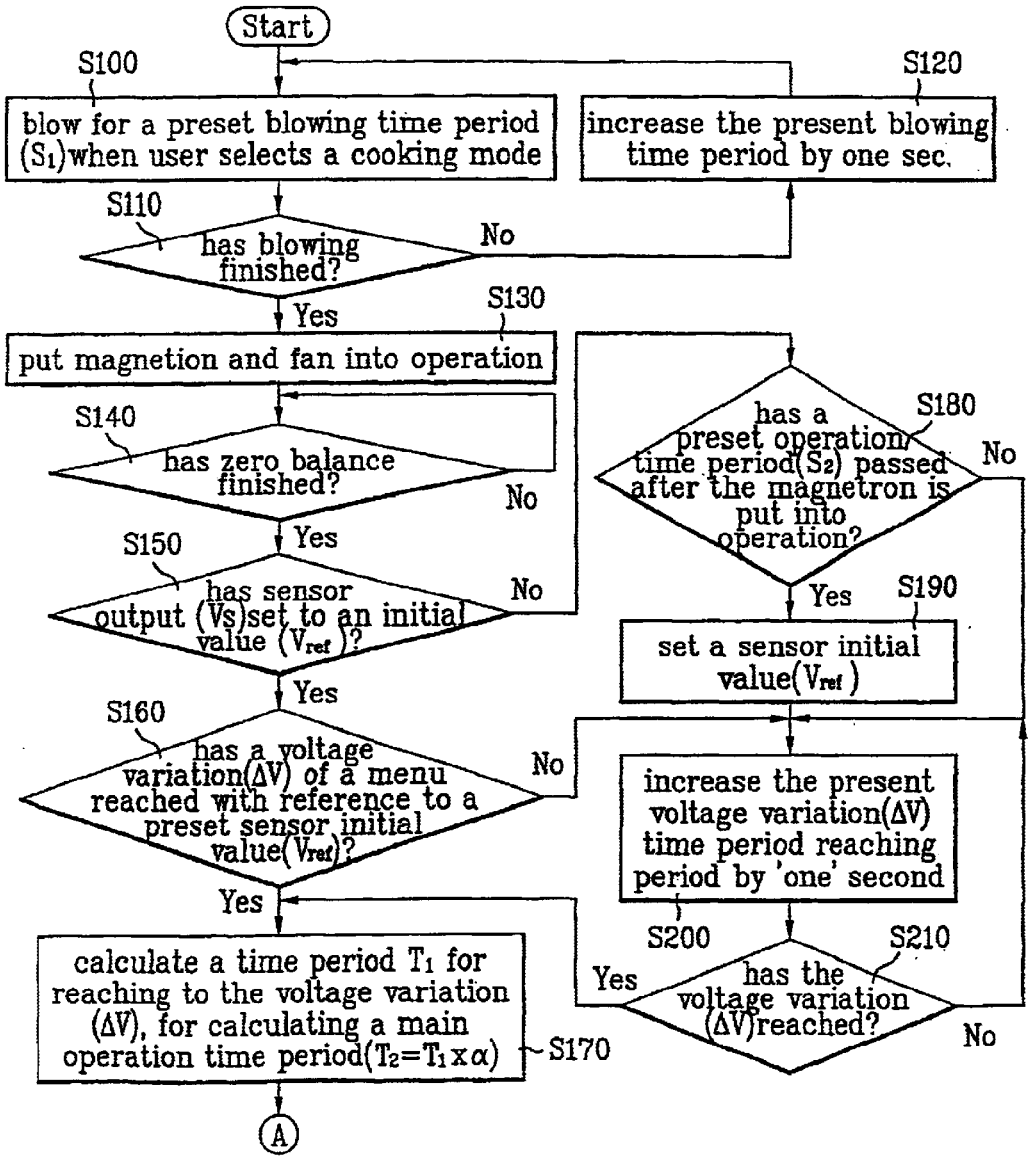
FIGS. 11A and 11B illustrate a flow chart showing the steps of a method for controlling a cooker having the bolometric humidity sensor of the present invention applied thereto.
Figure 11B:
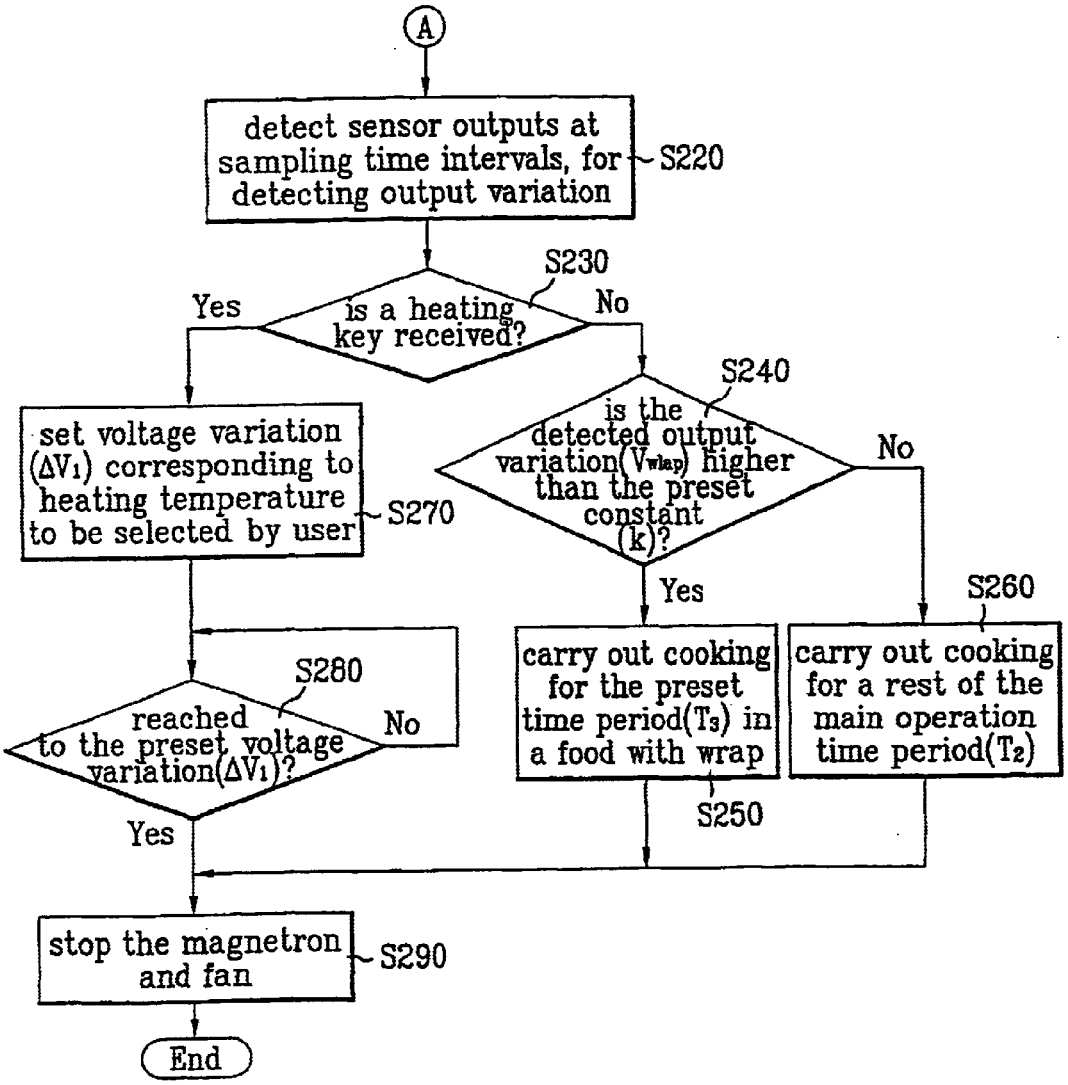
Figure 12:
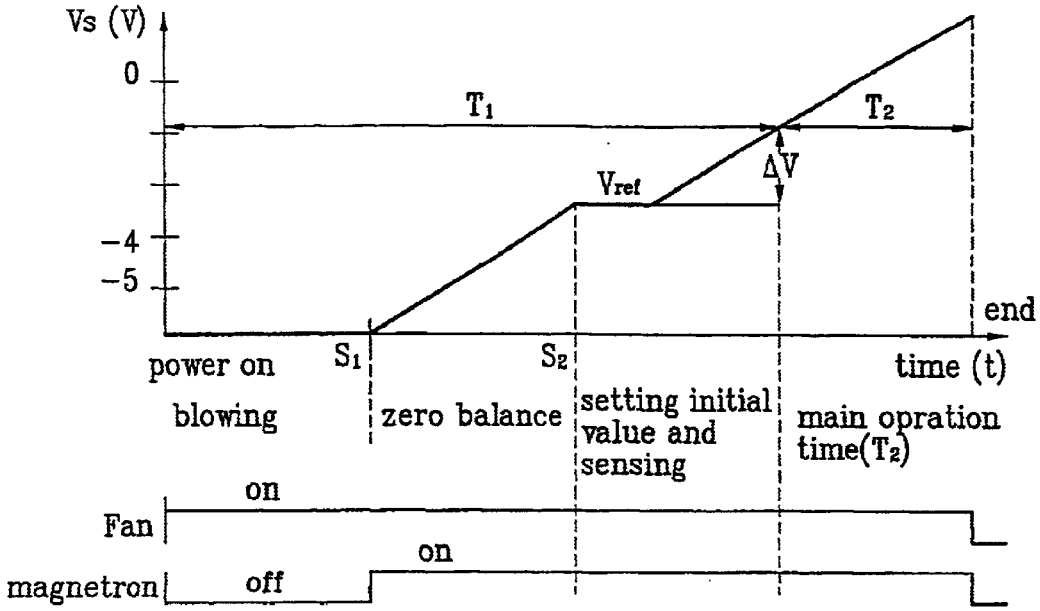
FIG. 12 illustrates a graph showing outputs vs. time periods of a bolometric humidity sensor when a cooker of the present invention is in operation.

A method for controlling a cooker having the bolometric humidity sensor applied thereto will be explained. FIGS. 11A and 11B illustrate a flow chart showing the steps of a method for controlling a cooker having the bolometric humidity sensor of the present invention applied thereto, and FIG. 12 illustrates a graph showing outputs vs. time periods of a bolometric humidity sensor when a cooker of the present invention is in operation, wherein an ordinate represents sensor outputs, and an abscissa represents a time period. There are control stages and operation states of the magnetron and the fan shown below the abscissa.

Referring to FIGS. 11A, 11B, and 12, when the user selects a cooking mode, the microcomputer applies a power to the fan, and drives for a preset blowing time period S1, for purging the cooking chamber (S100). Next, finish of the blowing is determined (S110). If it is found the blowing is not finished yet as a result of the determination (S110), the blowing time period is increased by '1' second (S120), and process is returned to the blowing step (S100), and a required step is carried out. If it is found the blowing is finished as a result of the determination (S110), the microcomputer applies power to the magnetron, to generate microwaves, and drives the fan continuously for dispersion of a heat (130). Next, at the same time with the putting the magnetron into operation, a sensor output of the bolometric humidity sensor is initialized, which may be explained in detail with reference to FIG. 8 as follows.

At first, the air discharged from the cooking chamber is introduced to the humidity sensing bolometric temperature sensing element through the first detection hole and the second detection holes, and the humidity sensing bolometric temperature sensing element generates a voltage V100 caused by a resistance corresponding to a temperature of the water vapor laden air, which is provided to the inversion (−) terminal on the amplifier 100. In this instance, the variable resistor VR connected to the humidity sensing bolometric temperature sensing element in parallel is varied, until a reference voltage V200 becomes identical to the output voltage, which is provided to the non-inversion (+) terminal on the amplifier 100. Then, the amplifier amplifies a voltage equal to a difference between the reference voltage V200 received at the non-inversion terminal and the output voltage V100 received at the inversion terminal, that is a sensor output value Vs. Eventually, the sensor output Vs is a voltage variation from the amplifier 100, from which the humidity in the cooking chamber can be known. If the reference voltage becomes the same with the output voltage of the humidity sensing bolometric, temperature sensing element 33 as the variable resistor VR is adjusted, there is no voltage difference at the amplifier 100, initializing the sensor. This state is called as a zero balance, and a sensor output Vs at this time is the initial value Vref.

According to a foregoing process, completion of the zero balance is determined (S40). If it is found that the zero balance is completed as a result of the determination (S140), setting of the sensor output Vs from the amplifier 100 of being the initial value Vref is determined (S150). If it is found that the sensor output Vs is set to the initial value Vref as a result of the determination (S150), reach of the sensor output to a voltage variation ΔV of the menu with reference to the initial value is determined (S160). That is, as a voltage variation is set with reference to the sensor initial value Vref for each menu the user is to select, reach of the sensor output to the voltage variation after the zero balance is determined. Next, if it is found that the sensor output Vs is reached to the voltage variation ΔV of the menu with reference to the initial value as a result of the determination (S160), a time period T1 required to reach to the voltage variation ΔV is calculated, to calculate the main operation time period T2 (S170). The main operation time period is calculated as follows.

$$T2=T1\times\alpha,$$

Where, 'α' denotes a quantitative compensating coefficient.

In the meantime, if the sensor output Vs is not set to the initial value, pass of a preset operation time period S2 after the magnetron is put into operation is determined (S180). If it is found that the preset operation time period S2 is passed after the magnetron is put into operation as a result of the determination (S180), the sensor output Vs at this time is set to be the initial value Vref (S190), the present voltage variation ΔV reach time is increased by '1' second (S200). Next, reach of the present voltage variation ΔV of which reach time is increased by '1' second to the voltage variation ΔV of the menu the user selected is determined (S210). If it is found that the present voltage variation ΔV is reached to the voltage variation ΔV of the menu with reference to the initial value as a result of the determination, a reach time period up to the present time T1 is calculated, to calculate the main operation time period T2 (S210). Opposite to this, if it is found that the present voltage variation ΔV is not reached to the voltage variation ΔV of the menu with reference to the initial value as a result of the determination (S210), the process is returned to the step (S200) for increasing the present voltage variation reach time period by '1' second, and the step (S200) is carried out. Next, after calculation of the main operation time period, output variations Vwrap of the sensor are detected at preset sampling time intervals through the bolometric humidity sensor for determining presence of wrap (S220). A rotation cycle of a turntable in the cooking chamber is used as the sampling time interval. For an example, the sensor output is detected at every one rotation of the turntable, and differences of the sensor outputs are calculated, to detect an output variation. Then, after the output variation Vwrap is detected, application of a heating key by the user is determined (S230). If it is determined that the heating key is applied by the user as a result of the determination (S230), a voltage variation ΔV1 corresponding to the food heating temperature is set (S270). Then, reach of the sensor output Vs detected through the bolometric humidity sensor to the voltage variation ΔV1 is determined (S280), and, if it is found that the sensor output Vs is reached to the voltage variation ΔV1 as a result of the determination, the magnetron and the fan are stopped, to finish cooking (S290).

Figure 13:
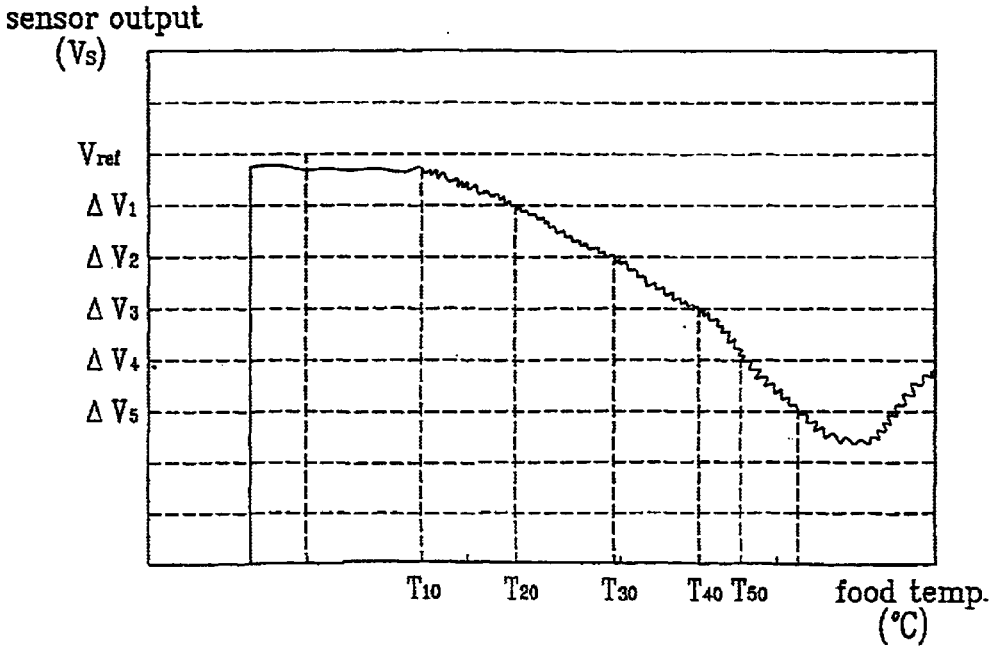
FIG. 13 illustrates a graph showing sensor outputs vs. food temperatures in a cooker of the present invention.

FIG. 13 illustrates a graph showing sensor outputs vs. food temperatures in a cooker of the present invention, wherein an ordinate represents the sensor outputs, and the abscissa represents temperatures.

Referring to FIG. 13, it can be known that the cooker of the present invention has a food temperature and a voltage variation are matched in 1:1 fashion, and the food temperature and the voltage variation have a linear relation within a certain section. Therefore, if the user applies the heating key for heating the food at a users desired setting temperature, the microcomputer stores a voltage variation ΔV1 corresponding to the setting temperature, and stops cooking if the sensor output Vs reaches to the voltage variation. Therefore, the cooker of the present invention permits the user to vary the heating setting temperature in a variety of fashion, and since the voltage of the bolometric humidity sensor set to a heating temperature is linear, a degree of food heating can be achieved, more accurately. If the user does not apply the heating key, in order to determine the food being covered with wrap, the sensor output variations Vwrap detected at the sampling time intervals are compared to a preset constant 'k' (S240).

Figure 14:
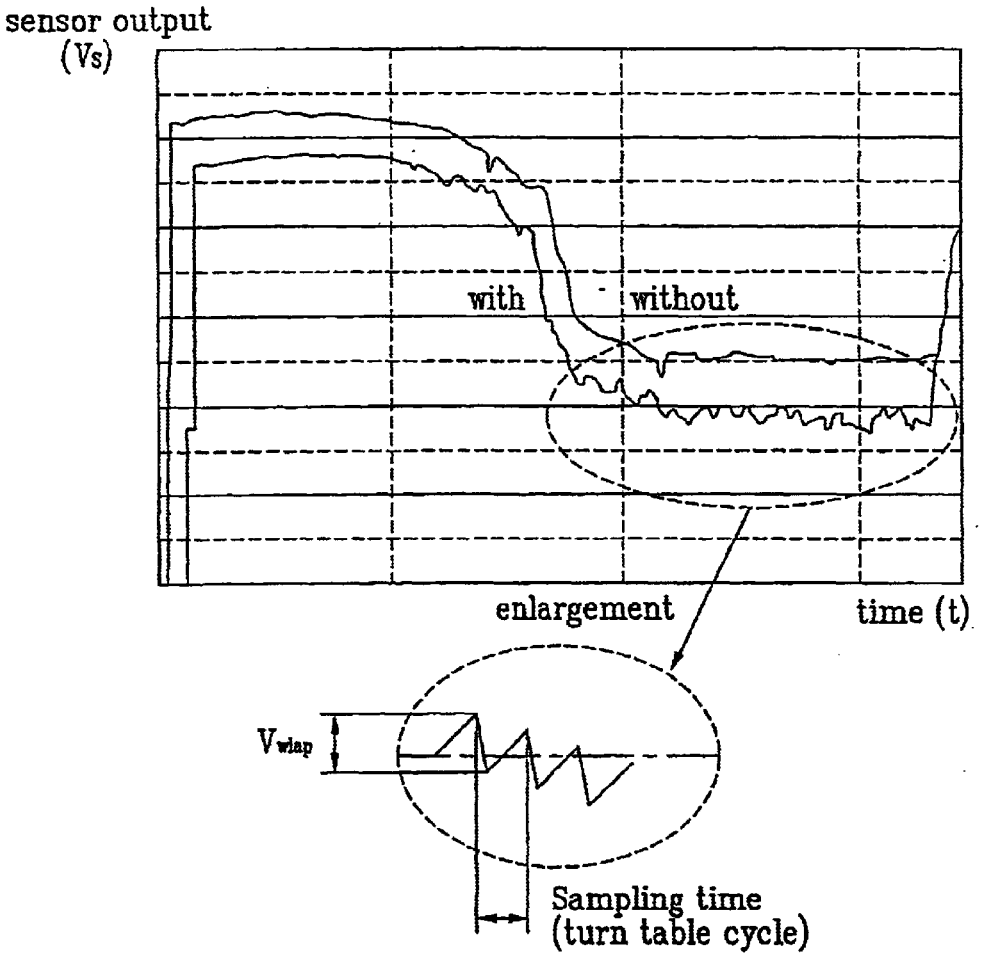
FIG. 14 illustrates a graph showing sensor outputs depending on use of wrap in a cooker of the present invention; and, FIG. 15 illustrates a graph showing sensor outputs vs. required cooking time periods of a cooker of the present invention.

FIG. 14 illustrates a graph showing sensor outputs depending on use of wrap in a cooker of the present invention, wherein an ordinate represents sensor outputs and an abscissa represents time.

Referring to FIG. 14, it can be known that a sensor output Vs in a case the food is covered with wrap is lower than the sensor output Vs in a case the food is not covered with wrap, and, from the enlarged drawing, it can be known that a variation of the sensor output Vs is great within a certain section when the food is covered with wrap. Therefore, the presence of wrap can be determined by detecting the sensor outputs Vs at fixed intervals, and comparing an output variation Vwrap, a difference of the sensor outputs, with a preset constant. That is, when the output variation is greater than the constant 'k', it is determined that the wrap is present, and, when the output variation is smaller than the constant 'k', it is determined that the wrap is not present.

Figure 15:
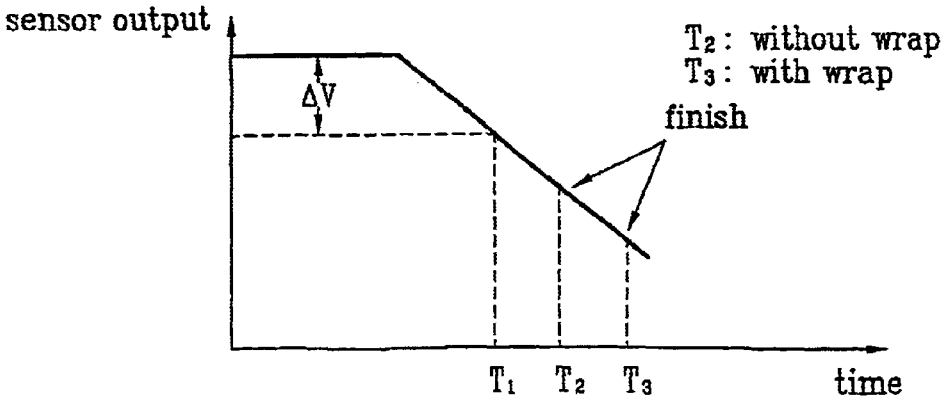

FIG. 15 illustrates a graph showing sensor outputs vs. required cooking time periods of a cooker of the present invention, wherein an ordinate represents the sensor outputs and an abscissa represents time.

Referring to FIG. 15, it can be known that the presence of wrap changes a required cooking time period. That is, a case the wrap is present requires a cooking time period somewhat longer than a case the wrap is not present since the wrap impedes penetration of the microwave from the magnetron. Therefore, when the output variation Vwrap is greater than the constant 'k', the cooking carried out for a new main operation time period T3 somewhat longer than the main operation time period T2 set before (S250). Then, the magnetron and the fan are stopped, to finish the cooking (S290). On the other hand, if the output variation Vwrap is smaller than the constant 'k', cooking is carried out for the main operation time period T2 set before (S260), and the magnetron and the fan are stopped too, for finishing the cooking (S290).

It will be apparent to those skilled in the art that various modifications and variations can be made in the bolometric humidity sensor, the cooker of the bolometric humidity sensor, and the method for controlling the cooker of the present invention without departing from the spirit or scope of the invention. Thus, it is intended that the present invention cover the modifications and variations of this invention provided they come within the scope of the appended claims and their equivalents.

INDUSTRIAL APPLICABILITY

The bolometric humidity sensor of the present invention can detect a humidity more accurate than the related art thermister type humidity sensor, by using a resistance difference caused by a temperature difference between water vapor and air by means of two bolometric temperature sensing elements, in which a resistance is linearly proportional to a temperature variation.

Welding of an additional heat unit to the case is not required for thermal equilibrium between the temperature sensing elements. Therefore, a productivity can be improved as the assembly is easy and the fabrication is simple.

The cooker having the bolometric humidity sensor of the present invention applied thereto can detect a humidity of the discharge air more accurately by fitting the bolometric humidity sensor on a bracket which makes a flow of the discharge air from the cooking chamber more active.

The method for controlling a cooker of the present invention can provide food which is cooked in an optimum condition to the user, because setting of a cooking time period can be varied with use of wrap on the food and a users desired heat temperature can be set as the bolometric humidity sensor having a linear output of the present invention is used.

What is claimed is:

1. A cooker having a bolometric humidity sensor applied thereto, comprising:

a cooking chamber in a body of the cooker having a space for accommodating food;

a magnetron for providing a heat for heating the food;

a fan for circulating air inside of the cooking chamber;

a "]" formed bracket at an end of an air outlet, wherein the air inside of the cooking chamber is discharged past the bracket to outside of the cooking chamber by an action of the fan, and wherein the bracket acts to deflect an air flow direction;

a bolometric humidity sensor inserted in the bracket for sensing a humidity of the outlet air; and a microcomputer for adjusting loads on the magnetron and the fan, based on a signal of the bolometric humidity sensor.

2. The cooker as claimed in claim 1, wherein the body has a protrusion at a part facing the bolometric humidity sensor protruded toward the bolometric humidity sensor for increasing a flow speed of the outlet air.

3. A method for controlling a cooker, comprising:

(1) having a microcomputer put a magnetron into operation, a bolometric humidity sensor detect a humidity, and an initial value being set according to a sensor output;

(2) calculating a main operation time period by using a time period the set sensor initial value reaches to the sensor output of a menu;

(3) after the main operation time period is calculated, detecting an output variation of the sensor at present sampling time intervals through the bolometric humidity sensor for determining presence of wrap;

(4) after the output variation is detected, determining reception of a heat key;

(5) when it is found that the heat key is received as a result of the determination, carrying out cooking until a voltage variation corresponding to a temperature of a selected key is detected through the bolometric humidity sensor, and stopping operation of the magnetron and the fan; and (6) when it is found that the heat key is not received as a result of the determination, determining the output variation of being greater than a preset constant, to change the main operation time period.

4. The method as claimed in claim 3, wherein, in a case the output variation is greater than the preset constant, the cooking is determined to be a case with wrap, and the magnetron and the fan are operated for a time period set longer than the main operation time period.

5. The method as claimed in claim 3, wherein, in a case the output variation is smaller than the preset constant, the cooking is determined to be a case without wrap, and the magnetron and the fan are operated for the main operation time period only.

* * * * *